US012686041B2

(12) United States Patent
Oribe

(10) Patent No.: US 12,686,041 B2
(45) Date of Patent: Jul. 21, 2026

(54) DEVICE AND METHOD FOR PRODUCING ROLL-FORMED PART

(71) Applicant: KAWASAKI JUKOGYO KABUSHIKI KAISHA, Kobe (JP)

(72) Inventor: Hiroki Oribe, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 318 days.

(21) Appl. No.: 18/228,671

(22) Filed: Aug. 1, 2023

(65) Prior Publication Data

US 2023/0372987 A1 Nov. 23, 2023

Related U.S. Application Data

(63) Continuation of application No. PCT/JP2022/005098, filed on Feb. 9, 2022.

(30) Foreign Application Priority Data

Feb. 9, 2021 (JP) ..... 2021-018905

(51) Int. Cl.
*B21B 17/14* (2006.01)

(52) U.S. Cl.
CPC ..... *B21B 17/14* (2013.01)

(58) Field of Classification Search
CPC ..... B21D 5/004; B21D 5/083; B21D 5/14; B21D 35/006; B21B 17/14
See application file for complete search history.

(56) References Cited

U.S. PATENT DOCUMENTS 2,870,817 A * 1/1959 Boldrini ..... B21D 5/14 72/175
3,268,985 A * 8/1966 Smith ..... B21D 7/08 72/171
4,117,702 A * 10/1978 Foster ..... B21D 11/10 72/173
4,893,489 A * 1/1990 Mason ..... B21D 7/08 72/173
7,076,979 B2 * 7/2006 Wilhelm ..... B21D 53/88 72/11.8

(Continued)

FOREIGN PATENT DOCUMENTS

JP 2011-062738 A 3/2011
JP 2019-104019 A 6/2019
JP 6741569 B2 8/2020

OTHER PUBLICATIONS

JP 07-80555A, Mori Mar. 1995.*
Translation JP 07-80555A, Mori Mar. 1995.*

*Primary Examiner* — Edward T Tolan
(74) *Attorney, Agent, or Firm* — XSENSUS LLP

(57) ABSTRACT

A device and method for producing an arc-shaped roll-formed part having an outer contour with a predetermined constant curvature and an inner contour with a varying curvature, having an outer contour with a varying curvature and an inner contour with a predetermined constant curvature, or having an outer contour with a varying curvature and an inner contour with a varying curvature. Circuitry obtains a third amount of movement corresponding to a sum of first and second amounts of movement of a bending roll as an amount by which the bending roll moves in a width direction during roll bending.

9 Claims, 10 Drawing Sheets

(56) References Cited

U.S. PATENT DOCUMENTS

| | | | | |
|---|---|---|---|---|
| 8,646,300 | B2 * | 2/2014 | Caporusso | G05B 19/19 72/18.2 |
| 10,661,323 | B2 * | 5/2020 | Okada | B21D 5/08 |
| 11,623,729 | B2 * | 4/2023 | Noebel | B21D 53/88 244/119 |
| 2017/0203350 | A1 | 7/2017 | Okada et al. | |
| 2019/0201959 | A1 | 7/2019 | Okada et al. | |
| 2021/0276063 | A1 | 9/2021 | Okada et al. | |

* cited by examiner

DEVICE AND METHOD FOR PRODUCING ROLL-FORMED PART

CROSS-REFERENCE TO RELATED APPLICATIONS

The present application is a bypass continuation of PCT Filing PCT/JP2022/005098, filed Feb. 9, 2022, which claims priority to JP 2021-018905, filed Feb. 9, 2021, both of which are incorporated by reference in their entirety.

BACKGROUND OF THE INVENTION

1. Field of the Invention

The present disclosure relates to a device and method for producing an arc-shaped roll-formed part having an outer contour with a predetermined constant curvature and an inner contour with a varying curvature, having an outer contour with a varying curvature and an inner contour with a predetermined constant curvature, or having an outer contour with a varying curvature and an inner contour with a varying curvature, by roll bending of a workpiece that is an elongate sheet material or elongate molded material having a varying-width portion where the width dimension of the workpiece varies in the longitudinal direction of the workpiece.

2. Description of the Related Art

Conventional devices for producing a roll-formed part by imparting a curvature to an elongate sheet material in its longitudinal direction are disclosed in Japanese Laid-Open Patent Application Publication No. 2019-104019 and Japanese Patent No. 6741569. With the production device of Japanese Laid-Open Patent Application Publication No. 2019-104019, the curvature can be adjusted continuously in the longitudinal direction. With the production device of Japanese Patent No. 6741569, a part whose cross-section varies in the longitudinal direction can be produced by roll forming.

Structural parts of a fuselage of an aircraft include a frame. The frame is an arc-shaped part extending in the circumferential direction of the fuselage. The outer contour of the frame has a constant curvature, while the inner contour of the frame may be shaped to have a varying curvature and an outward dent in order, for example, to widen the internal space of the fuselage.

If such a frame is produced by roll forming, a forming step where the workpiece is shaped to have a width that varies in the longitudinal direction of the workpiece needs to be followed by a bending step where the workpiece with the varying width is bent. However, Japanese Laid-Open Patent Application Publication No. 2019-104019, which discloses a technique for bending a workpiece with a constant width, fails to disclose a technique for bending a workpiece with a varying width such that the outer contour of the bent workpiece has a constant curvature and the inner contour of the bent workpiece has a varying curvature, a technique for bending a workpiece with a varying width such that the outer contour of the bent workpiece has a varying curvature and the inner contour of the bent workpiece has a constant curvature, or a technique for bending a workpiece with a varying width such that the outer contour of the bent workpiece has a varying curvature and the inner contour of the bent workpiece has a varying curvature. Japanese Patent No. 6741569, which discloses a technique for bending a workpiece with a varying width, fails to specifically disclose a roll control method or roll operation setting method for achieving a desired shape.

It is therefore an object of the present disclosure to provide an improved device and method for producing an arc-shaped roll-formed part.

SUMMARY OF THE INVENTION

A roll-formed part production device according to the present disclosure is a device that produces an arc-shaped roll-formed part by performing roll bending of a workpiece while transferring the workpiece with a longitudinal direction thereof extending along a bending path, the workpiece being an elongate sheet material or elongate molded material including a varying-width portion where a width dimension of the workpiece varies in the longitudinal direction of the workpiece, the device including: rolls including a transfer roll that contacts at least an outer periphery of the workpiece and transfers the workpiece in the longitudinal direction, a support roll that is located downstream of the transfer roll on the bending path and that contacts at least an inner periphery of the workpiece and defines a support point at which the workpiece is bent, and a bending roll that is located downstream of the support roll on the bending path and that contacts at least the outer periphery of the workpiece and bends the workpiece; a roll driver that moves the transfer roll, the support roll, and the bending roll in a width direction of the workpiece; and circuitry, wherein an amount of movement of each of the rolls in the width direction is set as an amount of contact movement of the roll in accordance with a position of the workpiece in the longitudinal direction based on the width dimension of the workpiece, an amount of movement of the workpiece in the width direction at a point where the workpiece contacts the support roll is set as an amount of origin shift in accordance with the position of the workpiece in the longitudinal direction based on the amount of contact movement of the support roll, an amount by which each of the rolls moves in the width direction in accordance with the position of the workpiece in the longitudinal direction is set as a first amount of movement of the roll by combining the amount of contact movement of the roll and the amount of origin shift, an amount by which the bending roll moves in the width direction in accordance with the position of the workpiece in the longitudinal direction to bend an outer contour of the workpiece to a predetermined curvature is set as a second amount of movement based on a shape of the workpiece at the point where the workpiece contacts the support roll, and the circuitry is configured to: obtain an amount of movement corresponding to a sum of the first and second amounts of movement of the bending roll as an amount of movement of the bending roll in the width direction; and based on the obtained amount of movement of the bending roll in the width direction, operate the roll driver that moves the bending roll.

A roll-formed part production method according to the present disclosure is a method that produces an arc-shaped roll-formed part by performing roll bending of a workpiece using rolls while transferring the workpiece with a longitudinal direction thereof extending along a bending path, the workpiece being an elongate sheet material or elongate molded material including a varying-width portion where a width dimension of the workpiece varies in the longitudinal direction of the workpiece, the rolls including a support roll that defines a support point at which the workpiece is bent and a bending roll that bends the workpiece, wherein an amount of movement of each of the rolls in the width direction is set as an amount of contact movement of the roll in accordance with a position of the workpiece in the longitudinal direction based on the width dimension of the workpiece, an amount of movement of the workpiece in the width direction at a point where the workpiece contacts the support roll is set as an amount of origin shift in accordance with the position of the workpiece in the longitudinal direction based on the amount of contact movement of the support roll, an amount by which each of the rolls moves in the width direction in accordance with the position of the workpiece in the longitudinal direction is set as a first amount of movement of the roll by combining the amount of contact movement of the roll and the amount of origin shift, an amount by which the bending roll moves in the width direction in accordance with the position of the workpiece in the longitudinal direction to bend an outer contour of the workpiece to a predetermined curvature is set as a second amount of movement based on a shape of the workpiece at the point where the workpiece contacts the support roll, the method including: obtaining an amount of movement corresponding to a sum of the first and second amounts of movement of the bending roll as an amount of movement of the bending roll in the width direction; and based on the obtained amount of movement of the bending roll in the width direction, operating a roll driver that moves the bending roll.

DETAILED DESCRIPTION

Embodiments

Hereinafter, exemplary embodiments of the present disclosure will be described with reference to the drawings.

Workpiece and Roll-Formed Part

Figure 1:
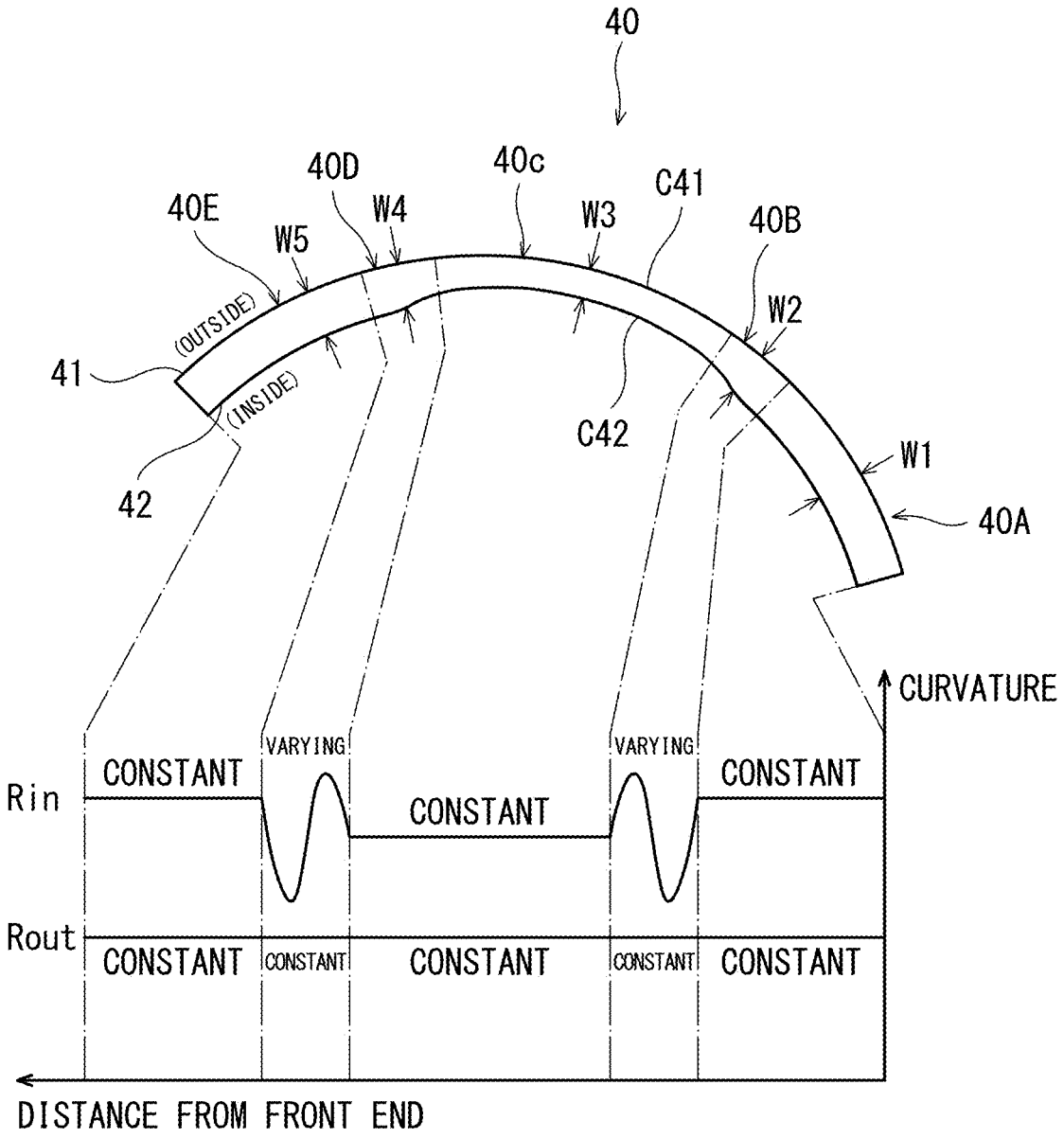
FIG. 1 is a front view schematically showing an example of the geometry of a roll-formed part formed by a roll-formed part production device of the present disclosure.

FIG. 1 is a front view schematically showing an example of the geometry of a roll-formed part formed by a roll-formed part production device of the present disclosure. This embodiment will be described using an example where the roll-formed part is a frame that is one of various structural parts for producing an aircraft fuselage and that is used in the cross-sectional direction, i.e., circumferential direction of the aircraft fuselage.

As shown on the upper side of FIG. 1, the roll-formed part 40 is generally arc-shaped. The roll-formed part 40 includes an outer periphery 41 and an inner periphery 42 having different profile shapes. A profile shape may also be referred to as a "contour" hereinafter. Specifically, as shown on the lower side of FIG. 1, a curvature Rout of an outer contour C41 of the outer periphery 41 is a predetermined constant curvature. The curvature Rout of the outer contour C41 will be referred to as a "first curvature" hereinafter. A curvature Rin of an inner contour C42 of the inner periphery 42 is a curvature that varies from portion to portion of the inner contour C42.

The roll-formed part 40 includes a first portion 40A, a second portion 40B, a third portion 40C, a fourth portion 40D, and a fifth portion 40E in order from one end (front end) to the other end of the roll-formed part 40. Each of the first portion 40A and the fifth portion 40E is a constant-width portion where a width dimension W1 or W5, which is a dimension between the outer periphery 41 and the inner periphery 42, is constant. In contrast, each of the second portion 40B, the third portion 40C, and the fourth portion 40D is a varying-width portion where a width dimension W2, W3, or W4 is not constant but varies. FIG. 1 illustrates a geometry where W1=W5 and W3<W1.

As stated above, the outer contour C41 of the roll-formed part 40 has a constant curvature. Thus, the difference in width dimension among the first portion 40A, the second portion 40B, the third portion 40C, the fourth portion 40D, and the fifth portion 40E is reflected in the variation of the inner contour C42. That is, the inner contour of each of the second portion 40B and the fourth portion 40D has a varying curvature. In contrast, the inner contour of the third portion 40C has a constant curvature since, although the width dimension W3 decreases in a direction from the second portion 40B toward the fourth portion 40D, the rate of decrease is constant. The roll-formed part 40 formable by the production device of the present disclosure is not limited to that in which the curvature Rout of the outer contour C41 is constant. For example, a roll-formed part having an outer contour shaped as a varying contour whose curvature varies in the longitudinal direction can be formed by the production device of the present disclosure.

Typical examples of the material of the roll-formed part 40 as used as a frame of an aircraft fuselage include aluminum and aluminum alloys. Examples of the material of the roll-formed part 40 as used for other purposes include iron-based materials such as iron and iron-containing alloys such as steel.

Figure 2:
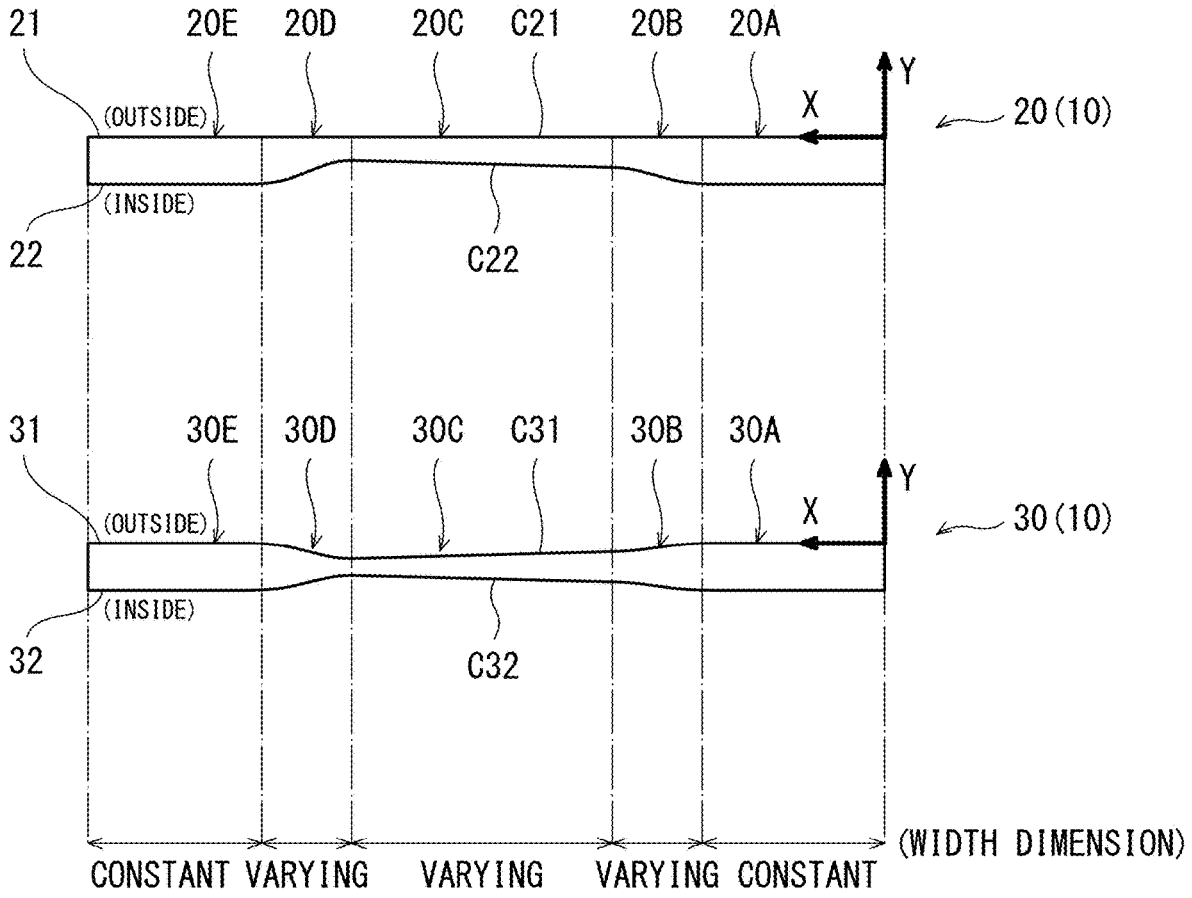
FIG. 2 is a front view schematically showing examples of the workpiece geometry and depicts a single-sided varying-contour workpiece and a double-sided varying-contour workpiece.
Figure 3:
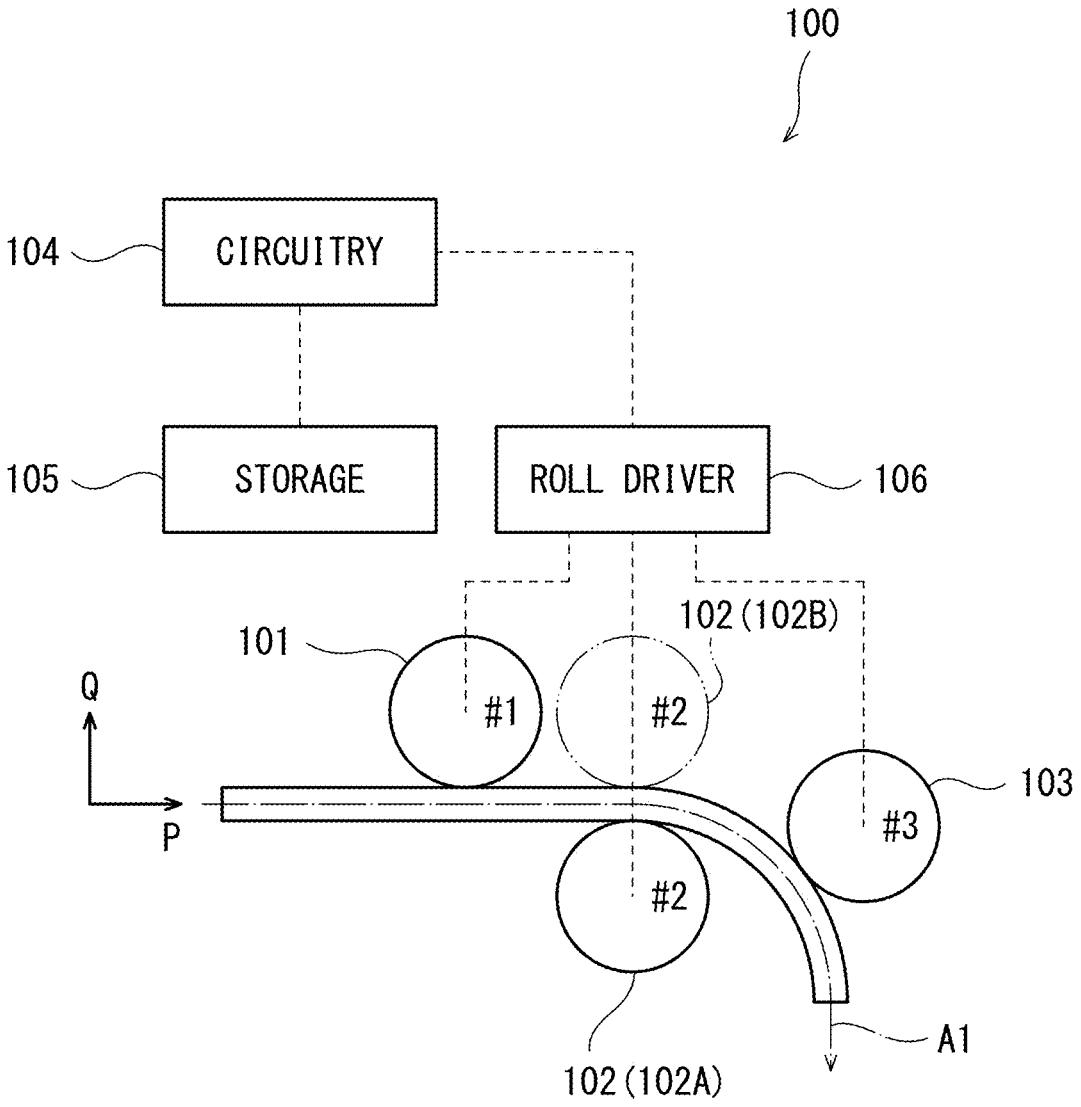
FIG. 3 is a schematic block diagram showing an example of the configuration of the production device.

The roll-formed part 40 is formed generally as follows. An elongate sheet material or elongate molded material is used as a starting object, which is subjected to roll forming in a first step, or equivalently a forming step, to obtain a workpiece 10 as an intermediate having a given cross-sectional shape as shown in FIG. 2. Next, as shown in FIG. 3, the workpiece 10 is transferred with its longitudinal direction extending along a bending path A1, and the workpiece 10 being transferred is subjected to roll bending in a second step, or equivalently a bending step, to obtain the roll-formed part 40 as a final product. The workpiece 10 having undergone the first step not only has a given cross-sectional shape but also includes a varying-width portion where the width dimension of the workpiece 10 varies in its longitudinal direction. This varying-width portion corresponds to the varying-width portion as described above for the roll-formed part 40.

FIG. 2 is a front view schematically showing an example of the geometry of the workpiece 10 to be processed by the roll-formed part production device of the present disclosure. A single-sided varying-contour workpiece 20 is shown on the upper side of FIG. 2, and a double-sided varying-contour workpiece 30 is shown on the lower side of FIG. 2. For the following description, an X-axis and a Y-axis are defined as shown in FIG. 2, with their origin at a point located on the downstream end of the outer periphery of the workpiece 10 in the transfer direction. The X-axis extends along the outer periphery of the workpiece 10 in a direction opposite to the transfer direction, and the Y-axis is orthogonal to the X-axis and extends outward away from the outer periphery. The same applies to the X-axis and the Y-axis shown in FIG. 1 and other figures.

As shown on the upper side of FIG. 2, the single-sided varying-contour workpiece 20 includes a first portion 20A, a second portion 20B, a third portion 20C, a fourth portion 20D, and a fifth portion 20E in order from the front to rear end of the workpiece 20. The first portion 20A, second portion 20B, third portion 20C, fourth portion 20D, and fifth portion 20E correspond to the first portion 40A, second portion 40B, third portion 40C, fourth portion 40D, and fifth portion 40E of the roll-formed part 40, respectively. Thus, each of the first portion 20A and the fifth portion 20E is a constant-width portion where a width dimension W1 or W5, which is a dimension between an outer periphery 21 and an inner periphery 22, is constant. Each of the second portion 20B, the third portion 20C, and the fourth portion 20D is a varying-width portion where a width dimension W2, W3, or W4 is not constant but varies. FIG. 2 illustrates a geometry where W1=W5 and W3<W1 as with the case of the roll-formed part 40.

Likewise, as shown on the lower side of FIG. 2, the double-sided varying-contour workpiece 30 includes a first portion 30A, a second portion 30B, a third portion 30C, a fourth portion 30D, and a fifth portion 30E in order from the front to rear end of the workpiece 30. The first portion 30A, second portion 30B, third portion 30C, fourth portion 30D, and fifth portion 30E correspond to the first portion 40A, second portion 40B, third portion 40C, fourth portion 40D, and fifth portion 40E of the roll-formed part 40, respectively. Thus, each of the first portion 30A and the fifth portion 30E is a constant-width portion where a width dimension W1 or W5, which is a dimension between an outer periphery 31 and an inner periphery 32, is constant. Each of the second portion 30B, the third portion 30C, and the fourth portion 30D is a varying-width portion where a width dimension is not constant but varies. FIG. 2 illustrates a geometry where W1=W5 and W3<W1 as with the case of the roll-formed part 40.

As described above, the width dimensions of the single-sided varying-contour workpiece 20 and the double-sided varying-contour workpiece 30 vary in the same manner in the longitudinal direction. The single-sided varying-contour workpiece 20 has an outer contour C21 shaped as a straight line with a curvature of zero and has an inner contour C22 shaped as a varying contour whose curvature varies at certain points. Thus, in the single-sided varying-contour workpiece 20, the amount of variation of the width dimension corresponds to the amount of variation of the inner contour C22 in the Y direction. In contrast, the double-sided varying-contour workpiece 30 has an outer contour C31 and an inner contour C32 both of which are not straight lines but each of which is a varying contour including a portion where the curvature varies. Thus, in the double-sided varying-contour workpiece 30, the amount of variation of the width dimension corresponds to the sum of the amounts of variation of the outer and inner contours C31 and C32 in the Y direction.

The double-sided varying-contour workpiece 30 shown in FIG. 2 is shaped such that the outer contour C31 and the inner contour C32 vary by the same amount at the same point in the longitudinal direction. That is, the outer contour C31 and the inner contour C32 of the double-sided varying-contour workpiece 30 are symmetrical about an axis extending between the center of the width of the front end of the double-sided varying-contour workpiece 30 and the center of the width of the rear end of the double-sided varying-contour workpiece 30. Thus, in the double-sided varying-contour workpiece 30 of FIG. 2, 50% of the amount of variation of the width dimension corresponds to the amount of variation of the outer contour C31, and the remaining 50% of the amount of variation of the width dimension corresponds to the amount of variation of the inner contour C32. The profile shape of the double-sided varying-contour workpiece 30 is not limited to that described above. For example, the outer contour and the inner contour may be asymmetrical about the axis, and that percentage of the amount of variation of the width dimension which corresponds to the amount of variation of the outer contour and the remaining percentage which corresponds to the amount of variation of the inner contour may be chosen as appropriate and may be, for example, 20% and 80%, respectively.

Roll-Formed Part Production Device

The following describes a configuration for roll bending of the workpiece 10 in the second step. FIG. 3 is a schematic block diagram showing an example of the configuration of the roll-formed part production device of the present disclosure. As shown in FIG. 3, the production device 100 includes rolls. In the present disclosure, the rolls include a transfer roll 101, a support roll 102, and a bending roll 103. The production device 100 further includes circuitry 104, a storage 105, and a roll driver 106.

The transfer roll 101 transfers the workpiece 10 having been subjected to roll forming in the first step; specifically, the transfer roll 101 rotates in contact with at least the outer periphery 21 or 31 of the workpiece 10, thus transferring the workpiece 10 downstream in its longitudinal direction along the bending path A1. As described in detail later, the transfer roll 101 is movable in the width direction of the workpiece 10. The transfer roll 101 may be not only movable in the width direction of the workpiece 10 but also turnable about a given center point. That is, the transfer roll 101 may be pivotable.

The support roll 102 is located downstream of the transfer roll 101 on the bending path A1. During the roll bending in the second step, the support roll 102 contacts at least the inner periphery 22 or 32 of the workpiece 10 to define a support point at which the workpiece 10 is bent. As described in detail later, the support roll 102 is movable in the width direction of the workpiece 10. The support roll 102 may be not only movable in the width direction of the workpiece 10 but also turnable about a given center point. That is, the support roll 102 may be pivotable. FIG. 3 shows two support rolls 102, one of which is an inner support roll 102A that contacts the inner periphery 22 or 32 and the other of which is an outer support roll 102B that contacts the outer periphery 21 or 31. The inner and outer support rolls 102A and 102B will be described later.

The bending roll 103 is located downstream of the support roll 102 on the bending path A1. During the roll bending in the second step, the bending roll 103 contacts at least the outer periphery 21 or 31 of the workpiece 10 to bend the workpiece 10. As described in detail later, the bending roll 103 is movable in the width direction of the workpiece 10. Additionally, the bending roll 103 is turnable about a given center point; that is, the bending roll 103 is pivotable. The production device 100 may include two or more bending rolls for bending the workpiece 10 or may include four or more rolls regardless of the number of each type of rolls.

As shown in FIG. 3, the direction in which the workpiece 10 is transferred between the transfer roll 101 and the support roll 102 is defined as a P direction, and the width direction of the workpiece 10 that is orthogonal to the P direction is defined as a Q direction. The P direction and the X direction are parallel to each other between the transfer roll 101 and the support roll 102. In a region downstream of the support roll 102 at the position of which the workpiece 10 is bent, the P direction and the X direction cross each other. In the production device 100 of this embodiment, the distance between the transfer roll 101 and the support roll 102 in the P direction is equal to the distance between the support roll 102 and the bending roll 103 in the P direction. In other words, the support roll 102 is located at the midpoint between the transfer roll 101 and the bending roll 103 in the P direction. The distance between the transfer roll 101 and the support roll 102 and the distance between the support roll 102 and the bending roll 103 need not be equal, although the order in which the rolls 101, 102, and 103 are arranged along the bending path A1 is unchangeable.

The circuitry 104 includes a processor or the like serving as a computing unit and controls the operation of the production device 100. In particular, the circuitry 104 controls the operation of the transfer roll 101, the support roll 102, the bending roll 103 and the like by operating the roll driver 106 based on data and computer programs stored in the storage 105 which includes various memories and an HDD. In FIG. 3 and the subsequent figures, an additional sign "#1" is attached to the transfer roll 101, an additional sign "#2" is attached to the support roll 102, and an additional sign "#3" is attached to the bending roll 103.

Figure 4:
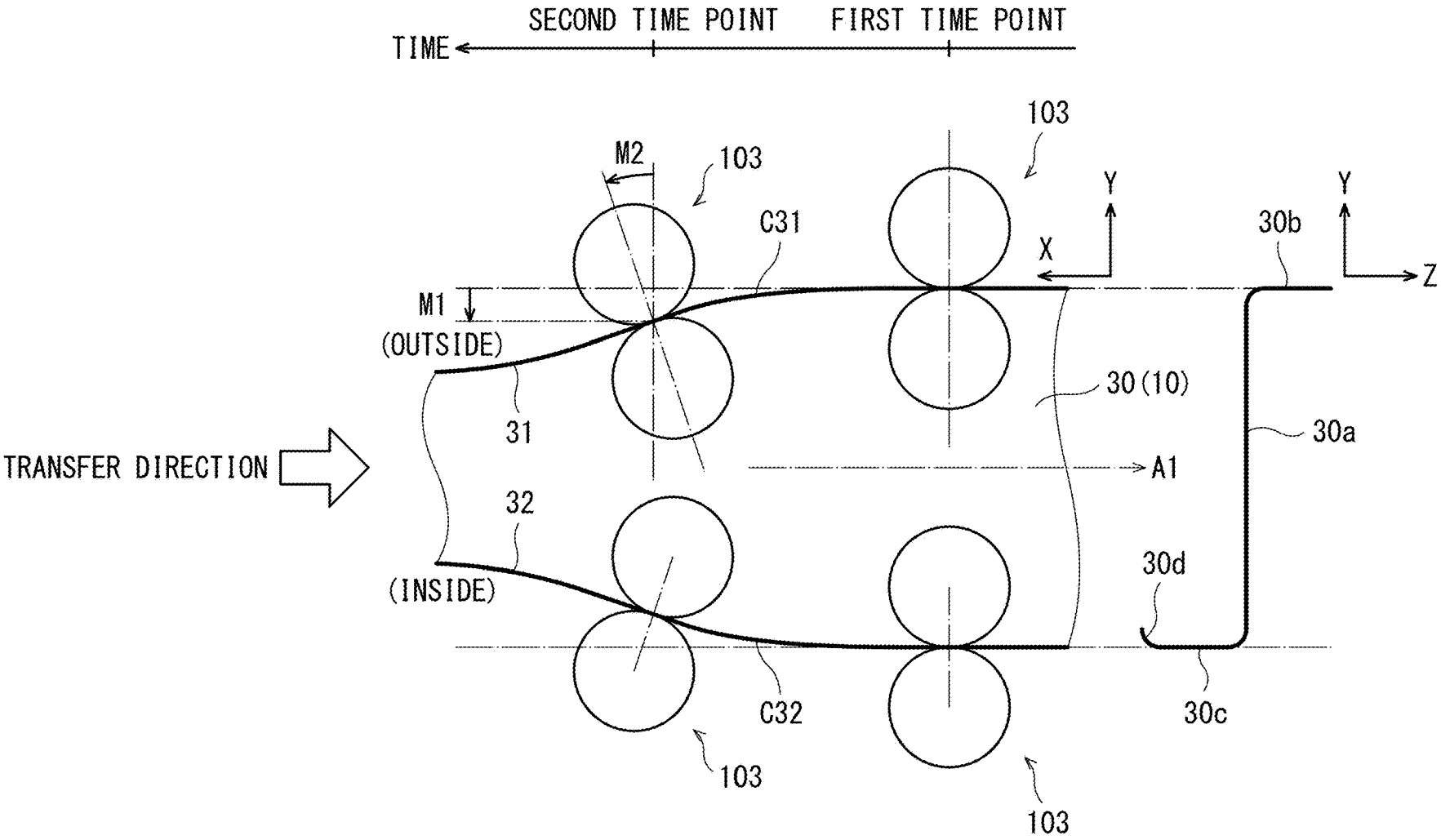
FIG. 4 is a schematic diagram illustrating how rolls of the production device move and showing an example of the cross-sectional shape of the workpiece.

FIG. 4 is a schematic diagram illustrating how the bending roll 103 of the production device 100 moves and showing an example of the cross-sectional shape of the workpiece 10. Although the bending roll 103 is illustrated in this figure, the transfer roll 101 and the support roll 102 may move in the same manner as the illustrated bending roll 103. Although the double-sided varying-contour workpiece 30 is illustrated as the workpiece 10, the single-sided varying-contour workpiece 20 may have the same cross-sectional shape.

The double-sided varying-contour workpiece 30 illustrated has a Z-shaped cross-section. That is, the cross-section of the double-sided varying-contour workpiece 30 is shaped to include: a web 30*a* extending along the Y-axis; a free flange 30*b* extending from one end of the web 30*a* along a Z-axis orthogonal to both the X-axis and the Y-axis; a flange 30*c* extending from the other end of the web 30*a* along the Z-axis in a direction opposite to that in which the free flange 30*b* extends; and a return flange 30*d* extending in a curve from the end of the flange 30*c* along the Y-axis. The cross-sectional shape shown in FIG. 4 is merely an example of the cross-sectional shape of the double-sided varying-contour workpiece 30, and the double-sided varying-contour workpiece 30 is not limited to the geometry as shown in FIG. 4.

In FIG. 4, a pair of outer bending rolls 103 between which the free flange 30*b* is held and a pair of inner bending rolls 103 between which the flange 30*c* is held are shown by way of example. The bending rolls 103 are depicted as being smaller than the workpiece 10 for convenience of illustration, but are not limited to having the size as shown in FIG. 4. In FIG. 4, there are shown a state where the bending rolls 103 are located on a large-width portion of the workpiece 10 at a first time point during the course of transfer of the workpiece 10 along the bending path A1 and a state where the bending rolls 103 are located on a small-width portion of the workpiece 10 at a second time point during the course of transfer of the workpiece 10 along the bending path A1.

In the production device 100, as indicated by the arrow M1 of FIG. 4, each of the bending rolls 103 is slidable in the Y direction or Q direction corresponding to the width direction of the double-sided varying-contour workpiece 30. Additionally, as indicated by the arrow M2, each of the bending rolls 103 is pivotable about the Z-axis with the pivotal center at, for example, a point of contact of the bending roll 103 with the double-sided varying-contour workpiece 30. Thus, as the point of contact of each bending roll 103 with the double-sided varying-contour workpiece 30 shifts from the large-width portion to the small-width portion during transfer of the double-sided varying-contour workpiece 30, the bending roll 103 moves in accordance with the variation of the outer contour C31 or inner contour C32 of the double-sided varying-contour workpiece 30. The movement of each bending roll 103 includes sliding movement and pivotal movement. Thus, each bending roll 103 can maintain contact with the outer periphery 31 or the inner periphery 32 over the entire course of transfer of the double-sided varying-contour workpiece 30.

In the production device 100, the operation of the transfer roll 101, the support roll 102, and the bending roll 103 is controlled through the roll driver 106 under control of the circuitry 104 during roll bending of the workpiece 10, and this control is done such that in the fifth portion 20E or 30E of the workpiece 10, which has constant inner and outer contours, the inner or outer contour of a region located upstream of the transfer roll 101 on the bending path A1 is always parallel to the P direction shown in FIG. 3. Based on this control, the production device 100 performs roll bending of the workpiece 10 in a manner as described below.

Such operation of the rolls 101, 102, and 103 during transfer of the workpiece 10 is implemented by the circuitry 104 operating the roll driver 106 based on data stored in the storage 105. To this end, the storage 105 pre-stores various kinds of data concerning the cross-sectional shape (length, width, thickness, etc.) and the material properties (Young's modulus etc.) of the workpiece 10 and data concerning computing equations that use the above various kinds of data as parameters to calculate the amount of movement including the amount of sliding movement and the amount of pivotal movement for each of the rolls 101, 102, and 103. Additionally or alternatively, the storage 105 pre-stores data concerning the amount by which each of the rolls 101, 102, and 103 moves in accordance with the position of the workpiece 10 in the longitudinal direction. In order to slide each of the rolls 101, 102, and 103 in the width direction of the workpiece 10 as described above, the roll driver 106 may include a linear actuator such as an electric actuator including an electric motor and a ball screw or a hydraulic actuator including a hydraulic pump and a hydraulic cylinder. In order to allow each of the rolls 101, 102, and 103 to turn about a given center point, i.e., in order to allow each of the rolls 101, 102, and 103 to pivot, the roll driver 106 may include a rotary actuator including an electric motor and a reducer including a pinion, a slewing gear, etc. The roll driver 106 may be configured such that multi-axis robots each of which has, for example, six axes are used to support the rolls 101, 102, and 103 and cause the rolls 101, 102, and 103 to slide and pivot.

[Forming of Double-Sided Varying-Contour Workpiece]

The following describes how the production device 100 operates in a production method for obtaining the roll-formed part 40 of FIG. 1 by roll bending of the workpiece 10. Roll bending of the double-sided varying-contour workpiece 30 will be described first, followed by description of roll bending of the single-sided varying-contour workpiece 20.

In roll bending of the double-sided varying-contour workpiece 30, the bending roll 103 is moved while the double-sided varying-contour workpiece 30 is supported by the transfer roll 101 and the support roll 102, thus bending the workpiece 30 at the point of contact with the support roll 102. The double-sided varying-contour workpiece 30 may be simply referred to as the "workpiece 30" hereinafter. The amount of movement of each of the rolls 101, 102, and 103 in this bending process includes a first amount of movement required for the roll 101, 102, or 103 to contact the surface of the workpiece 30 without causing bending of the workpiece 30. The amount of movement of the bending roll 103 includes, in addition to the first amount of movement, a second amount of movement required to bend the workpiece 30 to a desired curvature, namely the predetermined first curvature. As stated above, the first curvature is equal to the final curvature Rout of the outer contour C41 of the roll-formed part 40 obtained as a final product.

The first amount of movement (amount of sliding movement) is determined primarily from an amount of movement resulting from combining an amount of contact movement and an amount of origin shift. The amount of contact movement is the amount of variation of the workpiece 30's width dimension which varies in the longitudinal direction of the workpiece 30, and the amount of origin shift is the amount by which the workpiece 30 being transferred moves in the width direction in accordance with the behavior of the support roll 102. The second amount of movement (amount of sliding movement) of the bending roll 103 can be determined primarily from the shape of the workpiece 30 at the point of contact with the support roll 102. Thus, the first amount of movement is an amount of movement determined for each of the transfer roll 101, the support roll 102, and the bending roll 103, and the second amount of movement is an amount of movement determined for the bending roll 103.

The behavior of the support roll 102, which is mentioned above in the description of the first amount of movement, will now be briefly discussed. The details will be described later with reference to FIGS. 6A to 6D. As shown in FIG. 3, this embodiment includes two support rolls 102, one of which is the inner support roll 102A that contacts the inner periphery 32 of the workpiece 30 and the other of which is the outer support roll 102B that contacts the outer periphery 31 of the workpiece 30. The term "behavior of the support roll 102" is intended to include the behavior of the outer support roll 102B moved merely in accordance with the contour variation of the workpiece 30 and the behavior of the outer support roll 102B moved in a manner different from the movement in accordance with the contour variation or held in a fixed position. Depending on which behavior the outer support roll 102B performs, the outer periphery 31 of the workpiece 30 being transferred can change its position in the width direction. Thus, the amount of origin shift which is included in the first amount of movement of the bending roll 103 is a parameter that takes into account the amount by which the origin position of the bending roll 103 shifts as the outer periphery of the workpiece 30 moves in the width direction. The same is true for the amount of origin shift which is included in the first amount of movement of the transfer roll 101; that is, the amount of origin shift is a parameter that takes into account the amount by which the origin position of the transfer roll 101 shifts as the outer periphery of the workpiece 30 moves in the width direction. The "origin position" of each roll is a reference position representing the position of the roll and can be set as appropriate. For example, the position of the rotation center of each roll can be defined as the origin position of the roll.

Figure 5:
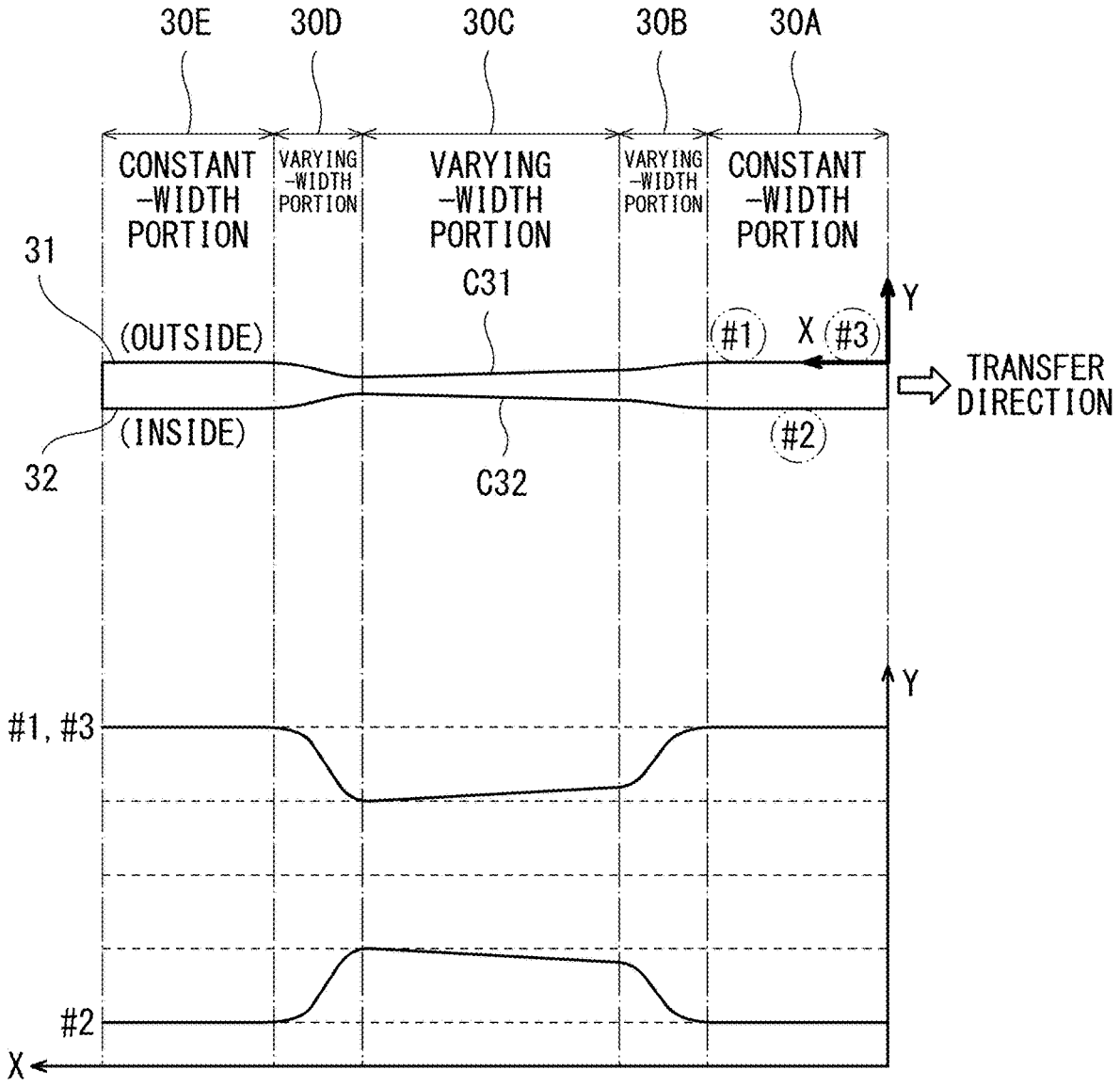
FIG. 5 is a schematic diagram for explaining how rolls move when they are placed in contact with the surface of the double-sided varying-contour workpiece.

The first amount of movement of each of the transfer roll 101, the inner support roll 102A, and the bending roll 103 will be described in more detail. FIG. 5 is a schematic diagram for explaining how the transfer roll 101, the inner support roll 102A, and the bending roll 103 move when they are placed in contact with the surface of the double-sided varying-contour workpiece 30 being transferred. As described above with reference to the lower side of FIG. 2, both the outer contour C31 and the inner contour C32 of the double-sided varying-contour workpiece 30 are varying contours. For example, the double-sided varying-contour workpiece 30 includes, in order from the downstream end to the upstream end, a first portion 30A having a constant curvature and a constant width, a second portion 30B having a varying curvature and a varying width, a third portion 30C having a constant curvature and a varying width, a fourth portion 30D having a varying curvature and a varying width, and a fifth portion 30E having a constant curvature and a constant width.

Thus, even when the bending roll 103 is merely placed in contact with the surface of the workpiece 30 being transferred without causing bending of the workpiece 30, the bending roll 103 needs to be slid in the Y direction in conformity with the outer contour C31 of the workpiece 30, as shown by the graph of #3 on the lower side of FIG. 5. Likewise, as shown by the graph of #1 on the lower side of FIG. 5, the transfer roll 101 needs to be slid in the Y direction in conformity with the outer contour C31 of the workpiece 30. Likewise, as shown by the graph of #2 on the lower side of FIG. 5, the inner support roll 102A needs to be slid in the Y direction in conformity with the inner contour C32 of the workpiece 30.

Figure 6A:
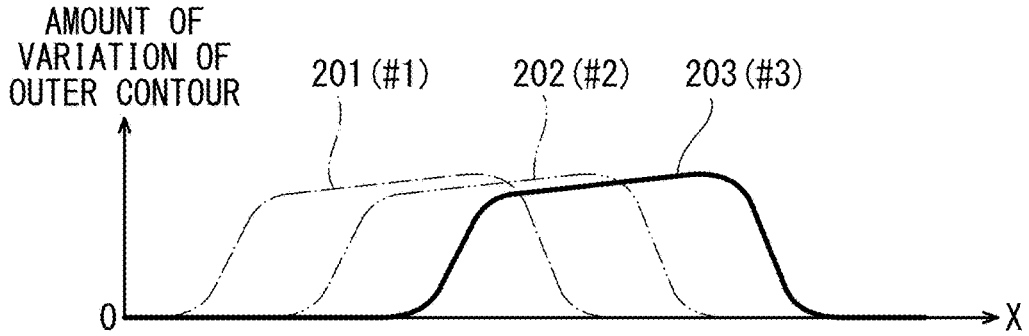
FIG. 6A is a schematic diagram for explaining first amounts of movement of a transfer roll, an outer support roll, and a bending roll.
Figure 6B:
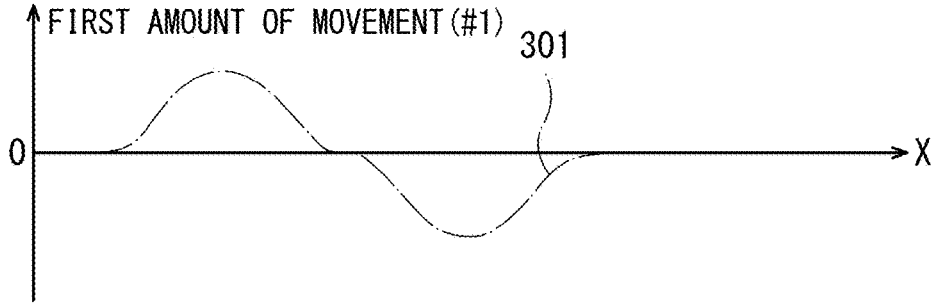
FIG. 6B shows the first amount of movement of the transfer roll.
Figure 6C:
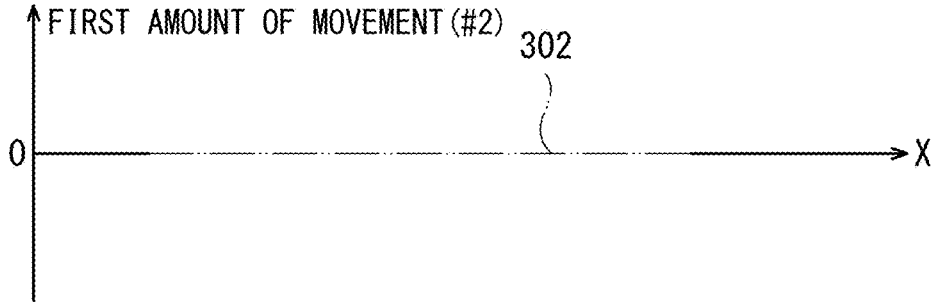
FIG. 6C shows the first amount of movement of the support roll.
Figure 6D:
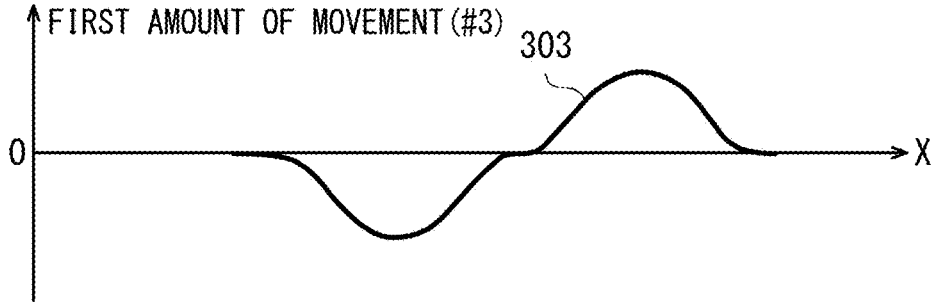
FIG. 6D shows the first amount of movement of the bending roll.

FIGS. 6A to 6D are schematic diagrams for explaining the amount of sliding movement, i.e., the first amount of movement, of each of the transfer roll 101, the outer support roll 102B, and the bending roll 103 which are placed in contact with the outer periphery 31 of the double-sided varying-contour workpiece 30 without causing bending of the double-sided varying-contour workpiece 30. FIG. 6A shows the absolute values of the amounts of variation of the outer contour C31 of the workpiece 30 at the respective positions of the transfer roll 101, the outer support roll 102B, and the bending roll 103 with respect to a point on the workpiece 30 that passes these rolls. In FIG. 6A, the dashed-dotted line 201 represents the amount of variation of the outer contour C31 of the workpiece 30 at the position of the transfer roll 101, the dashed-double dotted line 202 represents the amount of variation of the outer contour C31 of the workpiece 30 at the position of the outer support roll 102B, and the solid line 203 represents the amount of variation of the outer contour C31 of the workpiece 30 at the position of the bending roll 103. FIGS. 6B to 6D show the respective first amounts of movement of the rolls 101, 102B, and 103 for the case where the position of the outer support roll 102B in the width direction is fixed, that is, the case where the amount of movement of the outer support roll 102B in the width direction is fixed at zero. FIG. 6B shows the first amount of movement of the transfer roll 101, FIG. 6C shows the first amount of movement of the outer support roll 102B, and FIG. 6D shows the first amount of movement of the bending roll 103. In FIG. 6B, the positive direction of the axis representing the first amount of movement is a direction in which the transfer roll 101 moves toward the workpiece 30 in the width direction. Likewise, in FIG. 6D, the positive direction of the axis representing the first amount of movement is a direction in which the bending roll 103 moves toward the workpiece 30 in the width direction.

When the workpiece 30 is merely transferred in contact with the rolls 101, 102B, and 103 without being bent, the amount of contact movement of the transfer roll 101, the amount of contact movement of the outer support roll 102B, and the amount of contact movement of the bending roll 103 are determined by the distances the rolls 101, 102B, and 103 are moved in the Q direction to contact the outer periphery 31 of the workpiece 30 being transferred. In other words, the amounts of contact movement of the rolls 101, 102B, and 103 are determined by those amounts of variation of the outer contour C31 of the workpiece 30 which are represented by the curves 201 to 203 of FIG. 6A. Hereinafter, the amounts of variation of the outer contour C31 of the workpiece 30 at the positions of the rolls 101 to 103 may also be referred to as the amounts of contact movement of the rolls 101 to 103. When the rolls 101 to 103 are mentioned individually, the amount of shape variation of the workpiece 30 in the width direction, i.e., the amount of variation of the outer contour C31 of the workpiece 30, at the position of the transfer roll 101 is referred to as the amount of contact movement of the transfer roll 101, the amount of variation of the outer contour C31 of the workpiece 30 at the position of the support roll 102 is referred to as the amount of contact movement of the support roll 102, and the amount of variation of the outer contour C31 of the workpiece 30 at the position of the bending roll 103 is referred to as the amount of contact movement of the bending roll 103. Each of the amounts of contact movement varies in accordance with the amount of transfer of the workpiece 30, i.e., the position of the workpiece 30 in the longitudinal direction (transfer direction).

A point on the workpiece 30 in the longitudinal direction passes the transfer roll 101, the support roll 102, and the bending roll 103 sequentially during transfer of the workpiece 30. Thus, the variation of the outer contour C31 of the workpiece 30 at the position of the bending roll 103 occurs also at the position of each of the support roll 102 and the transfer roll 101 earlier by a time corresponding to the distance between the bending roll 103 and the support roll 102 or the transfer roll 101. For this reason, the amounts of variation of the outer contour C31 of the workpiece 30 at the positions of the rolls 101 to 103, as expressed with respect to a point on the workpiece 30 that is passing the bending roll 103, are as shown by the curves 201 to 203 of FIG. 6A.

In the case where the position of the outer support roll 102B in contact with the outer periphery 31 of the workpiece 30 is fixed in the width direction, the workpiece 30 being transferred along the bending path A1 moves in the Q direction in accordance with the shape variation of the outer contour C31 of the workpiece 30. Thus, the amount of sliding movement of each of the transfer roll 101 and the bending roll 103 needs to be adjusted in accordance with the amount of movement of the workpiece 30 in the Q direction. The amount of the adjustment of sliding movement is herein referred to as the amount of origin shift as described above. Thus, the first amount of movement of each roll is obtained by combining the amount of contact movement of the roll and the amount of origin shift. When the rolls are mentioned individually, the amount of movement of the transfer roll 101 in the width direction, as obtained by combining the amount of contact movement of the transfer roll 101 and the amount of origin shift, is referred to as the first amount of movement of the transfer roll 101, the amount of movement of the support roll 102 in the width direction, as obtained by combining the amount of contact movement of the support roll 102 and the amount of origin shift, is referred to as the first amount of movement of the support roll 102, and the amount of movement of the bending roll 103 in the width direction, as obtained by combining the amount of contact movement of the bending roll 103 and the amount of origin shift, is referred to as the first amount of movement of the bending roll 103. Each of the first amounts of movement varies in accordance with the amount of transfer of the workpiece 30, i.e., the position of the workpiece 30 in the longitudinal direction (transfer direction).

The following specifically describes the first amounts of movement of the rolls in the case where the amount of movement of the outer support roll 102B in the width direction is fixed at zero. In this case where the amount of movement of the outer support roll 102B in the width direction is fixed at zero, the amount of origin shift, by which the workpiece 30 moves in the width direction in accordance with the behavior of the support roll 102, is represented by a graph obtained by inverting the graph of FIG. 6A that represents the amount of contact movement 202 of the outer support roll 102B from positive to negative about the X-axis. Thus, the amount of contact movement 201 shown in FIG. 6A for the transfer roll 101 minus the amount of contact movement 202 shown in FIG. 6A for the outer support roll 102B, i.e., the amount of origin shift, is equal to the first amount of movement shown by the curve 301 of FIG. 6B for the transfer roll 101. The amount of contact movement 203 of the bending roll 103 minus the amount of contact movement 202 of the support roll 102, i.e., the amount of origin shift, is equal to the first amount of movement shown by the curve 303 of FIG. 6D for the bending roll 103. In this case, as seen from the curve 302 of FIG. 6C, the first amount of movement of the outer support roll 102B is constant at zero.

The outer support roll 102B is not limited to being held in a fixed position in the width direction, and may move in a manner different from movement in accordance with the shape variation of the outer contour C31 of the workpiece 30. Also in this case, the first amount of movement of each roll can be obtained by combining the amount of contact movement and the amount of origin shift in a way similar to that described above. That is, the first amount of movement of each of the rolls 101, 102, and 103 can be obtained as follows: the difference between the amount by which the outer contour C31 varies in the width direction at the point of contact with the outer support roll 102B when the workpiece 30 is transferred without being bent and the amount by which the outer support roll 102B moves in the width direction during this transfer of the workpiece 30 is multiplied by minus 1, the resulting product is used as the amount of origin shift, and the amount of contact movement of each of the rolls 101, 102, and 103 and the amount of origin shift are combined. In the case where the outer support roll 102B is moved in accordance with the shape variation of the outer contour C31, the amount of origin shift is zero, and thus the first amounts of movement of the rolls are the same as those represented by the curves 201 to 203 of FIG. 6A, respectively.

As seen from the foregoing description, the first amount of movement of the bending roll 103 is an amount of movement obtained from the amount by which the outer contour C31 of the workpiece 30 varies in the width direction at the point of contact with the bending roll 103 when the workpiece 30 is transferred without being bent. The curve 203 of FIG. 6A represents the thus obtained first amount of movement of the bending roll 103, in particular the first amount of movement in the case where the outer support roll 102B is moved in accordance with the shape variation of the outer contour C31 of the workpiece 30. In the case where the outer support roll 102B is moved in a manner different from the movement in accordance with the shape variation of the outer contour C31, an amount of movement obtained by subtracting the amount of variation of the outer contour C31 of the workpiece 30 in the width direction at the point of contact with the support roll 102 (this amount of variation corresponds to the amount of origin shift) from the amount of variation of the outer contour C31 of the workpiece 30 at the point of contact with the bending roll 103 (this amount of variation corresponds to the amount of contact movement) is the first amount of movement of the bending roll 103. The curve 303 of FIG. 6D represents the thus obtained first amount of movement of the bending roll 103.

Figure 7:
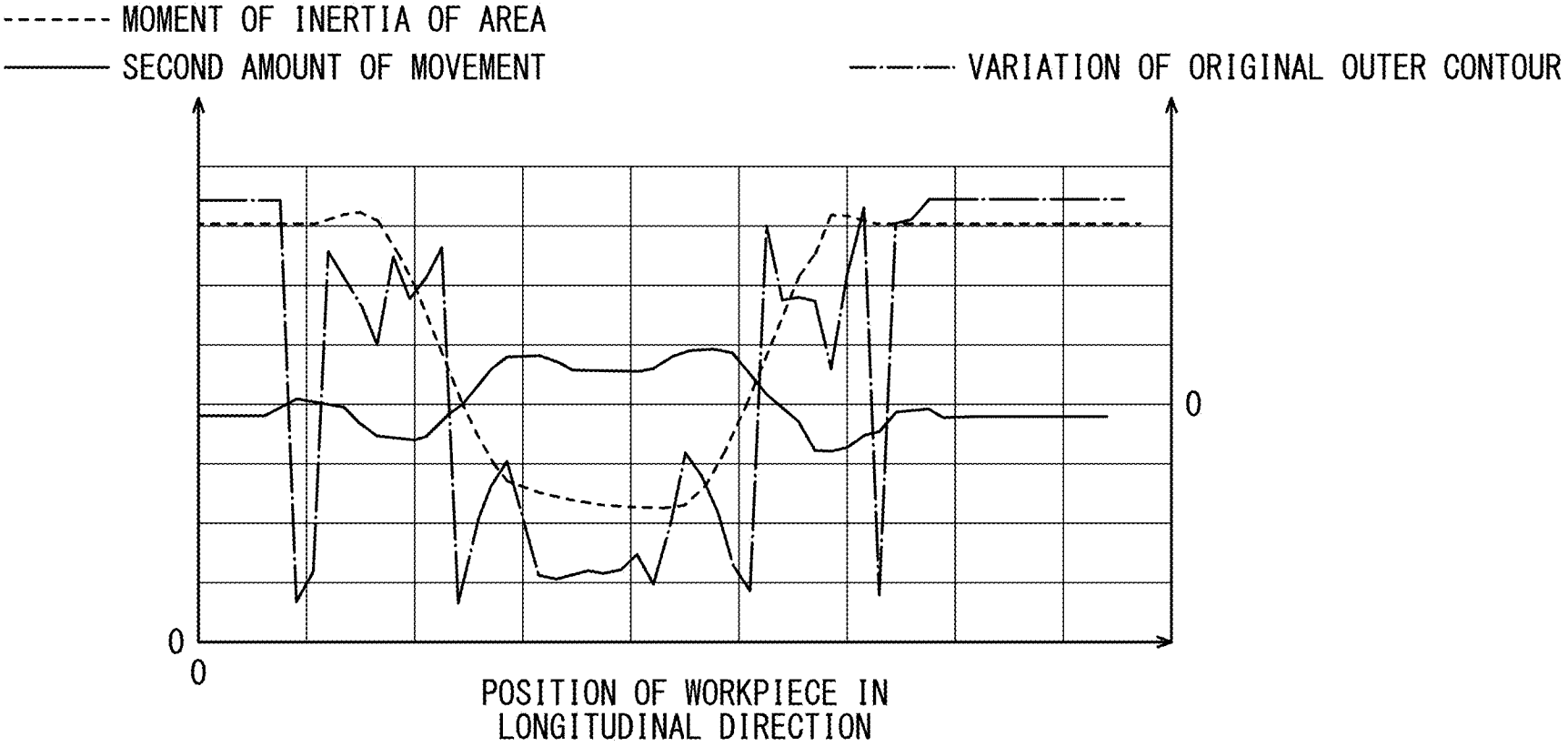
FIG. 7 is a schematic diagram for explaining a second amount of movement of the bending roll in the case where the workpiece is the double-sided varying-contour workpiece.

Hereinafter, the second amount of movement of the bending roll 103 will be described. FIG. 7 is a schematic diagram for explaining the second amount of movement by which the bending roll 103 is required to move to bend the outer periphery 31 of the double-sided varying-contour workpiece 30 to the predetermined first curvature. In FIG. 7, the dashed line represents an example of the moment of inertia of area of the workpiece 30 at the point of contact with the support roll 102, the dashed-dotted line represents an example of the change in a curvature R defining the outer contour C31 of the original workpiece 30 that has not yet been subjected to roll bending, and the solid line represents an example of the second amount of movement of the bending roll 103.

As shown in FIG. 7, in the case where the first curvature is imparted to the workpiece 30, the amount of sliding movement which is included in the second amount of movement of the bending roll 103 is set as an amount of movement that increases or decreases generally as a function of the moment of inertia of area of the workpiece 30 at the point of contact with the support roll 102 and the change in the curvature R defining the outer contour C31 of the workpiece 30 that has not yet been subjected to roll bending. More specifically, the second amount of movement is set based on the moment of inertia of area of the workpiece 30 at the point of contact with the support roll 102 and the curvature R defining a contour that is the original shape of the outer contour C31 of the workpiece 30. After the bending, spring back occurs in that portion of the workpiece 30 at which the workpiece 30 has been bent. Thus, the second amount of movement may be set taking into account the amount of spring back as well as the moment of inertia of area.

Figure 8:
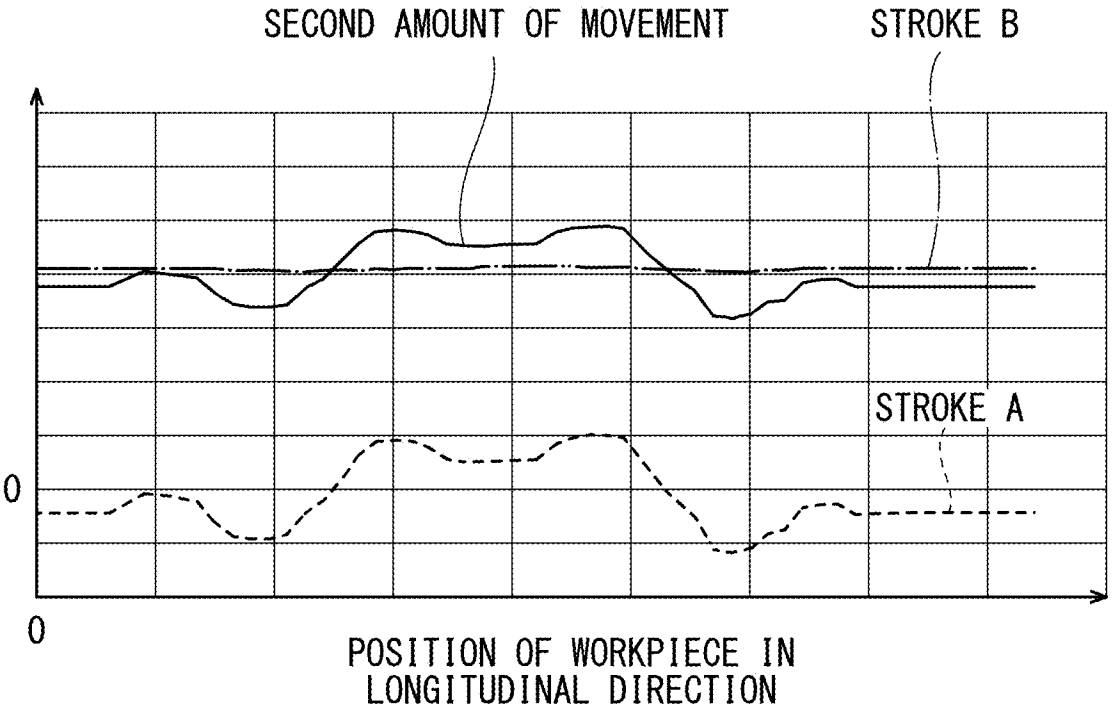
FIG. 8 is a schematic diagram for explaining how to set the second amount of movement of the bending roll based on a moment of inertia of area and an original outer contour shape.

An example of how to calculate the second amount of movement will be described in more detail with reference to FIGS. 7 and 8. In FIG. 8, the dotted line represents a stroke A required to form different portions of the workpiece 30 into shapes with a desired curvature, and the dashed-dotted line represents a stroke B required to form the outer contour C31 in a straight shape. The second amount of movement of the bending roll 103 is expressed as the sum of the stroke A calculated from the moments of inertia of area, which are represented by the dashed line of FIG. 7, at the different portions of the workpiece 30 and the stroke B calculated from the original shape of the outer contour C31 which is represented by the dashed-dotted line of FIG. 7. Alternatively, the second amount of movement of the bending roll 103 is expressed as the sum of the strokes A and B respectively multiplied by given coefficients. Thus, in the case where the outer contour of the workpiece 30 is shaped as a varying contour, the roll bending can be understood as if the outer contour of the workpiece 30 is first formed into a straight shape using the stroke B and then the straightened outer contour of the workpiece 30 is bent to a desired curvature using the stroke A. In practice, these forming procedures are accomplished simultaneously.

In order to allow the workpiece 30 to have a desired curvature ρ' taking into account the amount of spring back, a curvature ρ to be imparted to the workpiece 30 by the forming process is calculated by the following equations (1) and (2).

[Equation 1]

$$M = 2\cdot\left\{b\cdot E\cdot\left(\frac{1}{\rho}\right)\cdot\left(\frac{1}{3}\eta_e^{\,3}\right) + b\cdot F\cdot\left(\frac{1}{\rho}\right)^n\cdot\frac{1}{n+2}\cdot\left(t^{n|2} - \eta_e^{\,n|2}\right)\right\} \tag{1}$$

[Equation 2]

$$\frac{1}{\rho'} = \frac{1}{\rho} - \frac{M}{E\cdot I} \tag{2}$$

The equation (1) expresses a moment required for plastic bending of a material assumed to obey the n-th power hardening law, and the equation (2) defines the amount of spring back. In the equation (1), b is a sheet width, 2t is a sheet thickness, and E, F, n, and $\eta_e$ are material constants. In the equation (2), ρ is a curvature before spring back, ρ' is a curvature after spring back, and I is a moment of inertia of area.

In the case where, for example, a component having an original shape with a curvature R is formed into a straight shape, the required amount of forming is equal to the amount of forming required to bend an originally straight component to the curvature R. Thus, the stroke B, i.e., the amount of forming (curvature ρ) required to form the original outer contour C31 into a straight shape can be obtained by the equations (1) and (2) using the shapes (curvature) of different portions of the original outer contour C31 as the shapes (curvature ρ') that the different portions have after spring back.

A change in the stroke of the bending roll 103 results in a forming strain acting on the point of contact of the workpiece 30 with the support roll 102. Thus, the stroke of the bending roll 103 is controlled such that the forming strain allows the point of contact to have the curvature ρ determined as described above. The portion of the workpiece 30 that has passed the bending roll 103 is released from the restraint of the rolls, and forms into a final shape with the curvature ρ' at the completion of spring back. That is, in the section between the support roll 102 and the bending roll 103, the curvature of the workpiece 30 gradually changes from the curvature ρ to the curvature ρ'. Thus, the stroke of the bending roll 103, i.e., the second amount of movement, can be geometrically determined taking into account the change in curvature.

In the case where the influence of the portions of the workpiece 30 that are other than the web 30*a* is negligible, the second amount of movement may be set based on the width dimension of the web 30*a*. Alternatively, the second amount of movement may be set based on the cross-sectional area of the workpiece 30. Alternatively, the second amount of movement may be set by using the width dimension of the web 30*a* and the cross-sectional area of the workpiece 30 in appropriate combination taking into account other parameters as necessary. For example, the second amount of movement may be set by using one or more or all of the following parameters multiplied by suitable coefficients: the moment of inertia of area, the variation of the outer contour C31 of the workpiece 30 that has not yet been subjected to roll bending, and the amount of spring back.

Although the second amount of movement as described above is set to obtain the amount of sliding movement of the bending roll 103, the point at which the workpiece is bent is where the workpiece is in contact with the support roll 102. Thus, the time to move the bending roll 103 based on the set second amount of movement is when a portion of the workpiece reaches the support roll 102, the portion of the workpiece being that for which the moment of inertia of area taken into account to set the second amount of movement was obtained.

Figure 9A:
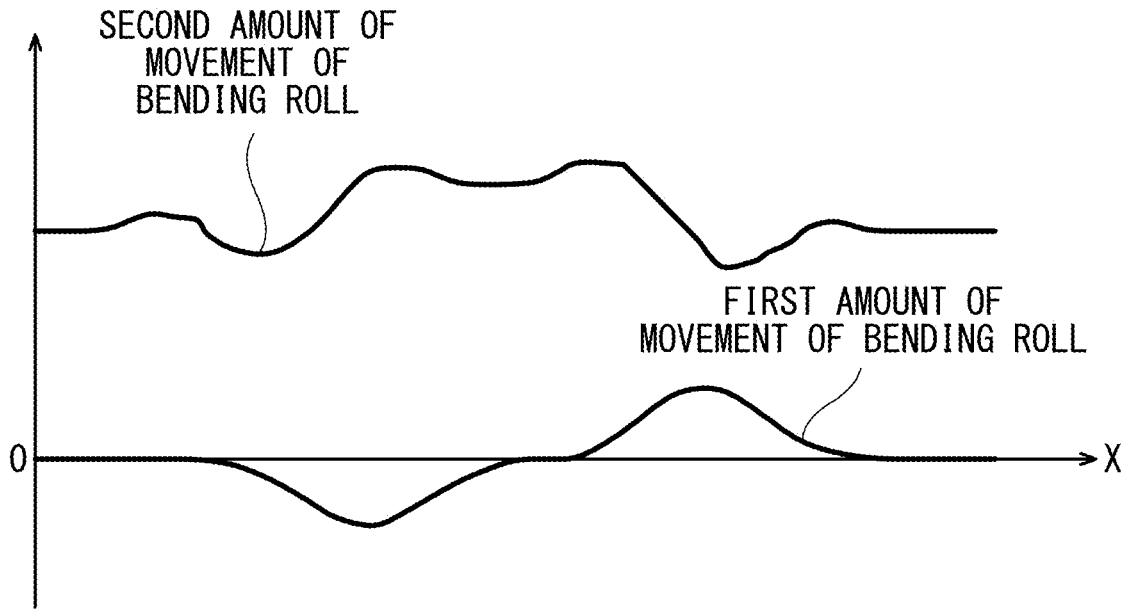
FIG. 9A is a schematic diagram for explaining how the bending roll moves in the case where the workpiece is the double-sided varying-contour workpiece.
Figure 9B:
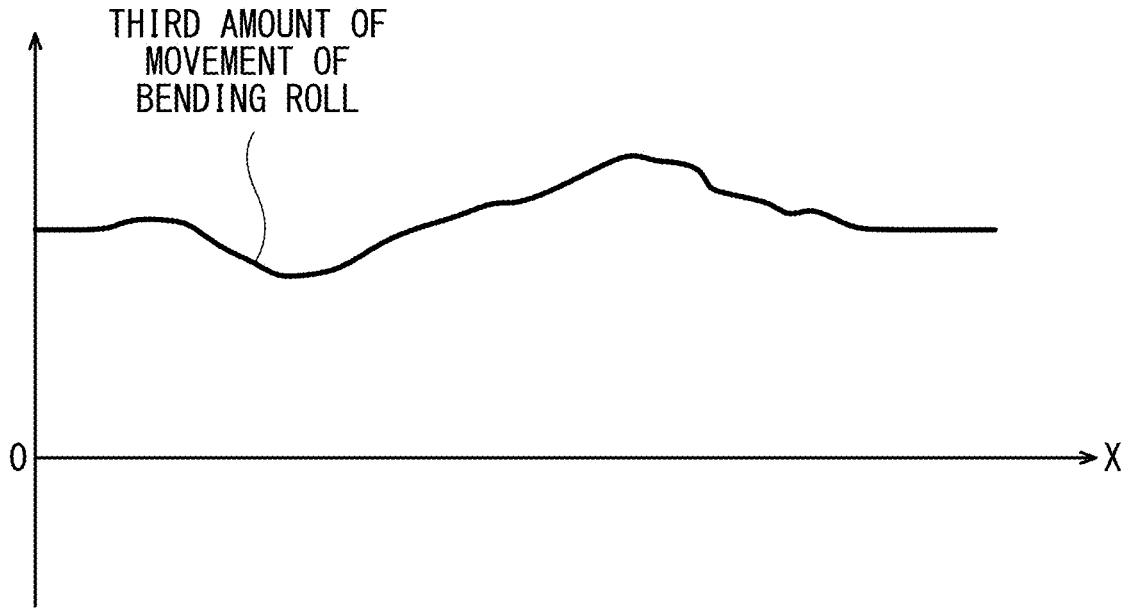
FIG. 9B shows a third amount of movement resulting from combining the first and second amounts of movement of the bending roll.

The ultimate amount of movement of the bending roll 103 in the roll bending is defined as a third amount of movement of the bending roll 103, and the third amount of movement results from combining the first and second amounts of movement descried above. FIGS. 9A and 9B are schematic diagrams for explaining the amount by which the bending roll 103 is required to move to impart a final curvature to the double-sided varying-contour workpiece 30. FIG. 9A shows the first and second amounts of movement which have not yet been combined, and FIG. 9B shows the third amount of movement which is a combined amount of movement resulting from combining the first and second amounts of movement. In the production device 100, the circuitry 104 combines the first and second amounts of movement to obtain the third amount of movement of FIG. 9B as the amount of movement of the bending roll 103 in the width direction. The circuitry 104 operates the roll driver 106 based on the obtained third amount of movement to control the bending roll 103 and move the bending roll 103 in the width direction.

For the transfer roll 101, the circuitry 104 obtains the above-described first amount of movement of the transfer roll 101 as the amount of movement in the width direction during the roll bending, i.e., as a third amount of movement of the transfer roll 101. The circuitry 104 operates the roll driver 106 based on the obtained third amount of movement, i.e., the first amount of movement, to control the transfer roll 101 and move the transfer roll 101 in the width direction. For the support roll 102, the circuitry 104 obtains the above-described first amount of movement of the support roll 102 as the amount of movement in the width direction during the roll bending, i.e., as a third amount of movement of the support roll 102. The circuitry 104 operates the roll driver 106 based on the obtained third amount of movement, i.e., the first amount of movement, to control the support roll 102 and move the support roll 102 in the width direction. Thus, in the roll bending, the transfer roll 101 and the support roll 102 are moved based on the respective first amounts of movement, and the bending roll 103 is moved based on the third amount of movement resulting from combining the above-described first and second amounts of movement. In consequence, the double-sided varying-contour workpiece 30 is formed into the roll-formed part 40 shown in FIG. 1.

In the foregoing description, for the purpose of convenience, the ultimate amount of movement of the bending roll 103 is divided into the first and second amounts of movement, which are described individually, and the third amount of movement resulting from combining the first and second amounts of movement is described as the ultimate amount of movement. However, it is not essential to obtain the first and second amounts of movement individually and then combine the first and second amounts of movement. That is, the process of obtaining the amount of movement of the bending roll 103 in the width direction is not limited in any respect and may be any kind of process by which an amount of movement corresponding to the sum of the above-described first and second amounts of movement is ultimately obtained as the amount of movement of the bending roll 103 in the width direction.

[Forming of Single-Sided Varying-Contour Workpiece]

The following describes how the production device 100 operates in a production method for obtaining the roll-formed part 40 of FIG. 1 by roll bending of the single-sided varying-contour workpiece 20.

As shown on the upper side of FIG. 2, the single-sided varying-contour workpiece 20 that has not yet been subjected to roll bending has an outer contour C21 shaped as a straight line and an inner contour C22 shaped as a varying contour. That is, the main difference between the single-sided varying-contour workpiece 20 and the double-sided varying-contour workpiece 30 is that while the outer contour C31 of the double-sided varying-contour workpiece 30 is a varying contour whose curvature is not constant, the outer contour C21 of the single-sided varying-contour workpiece 20 is a straight line with a curvature of zero. Hereinafter, the single-sided varying-contour workpiece 20 may be simply referred to as the "workpiece 20".

Thus, as seen from the description of the double-sided varying-contour workpiece 30, the first amounts of movement of the transfer roll 101, the support roll 102 (outer support roll 102B), and the bending roll 103 in roll bending of the single-sided varying-contour workpiece 20 are all constant and may be, for example, zero.

Figure 10A:
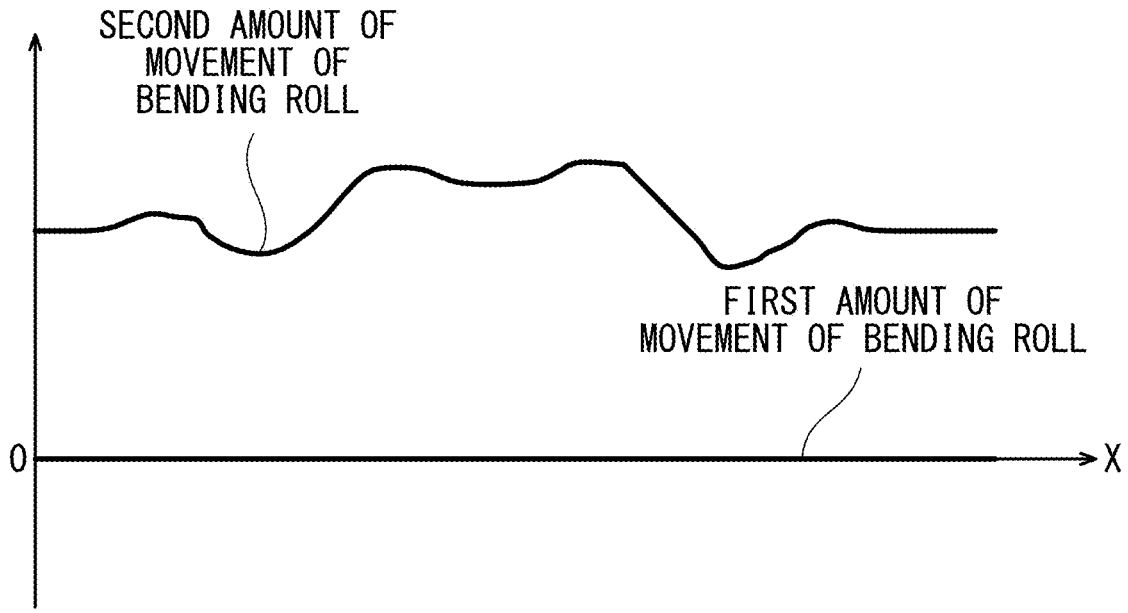
FIG. 10A is a schematic diagram for explaining how the bending roll moves in the case where the workpiece is the single-sided varying-contour workpiece.
Figure 10B:
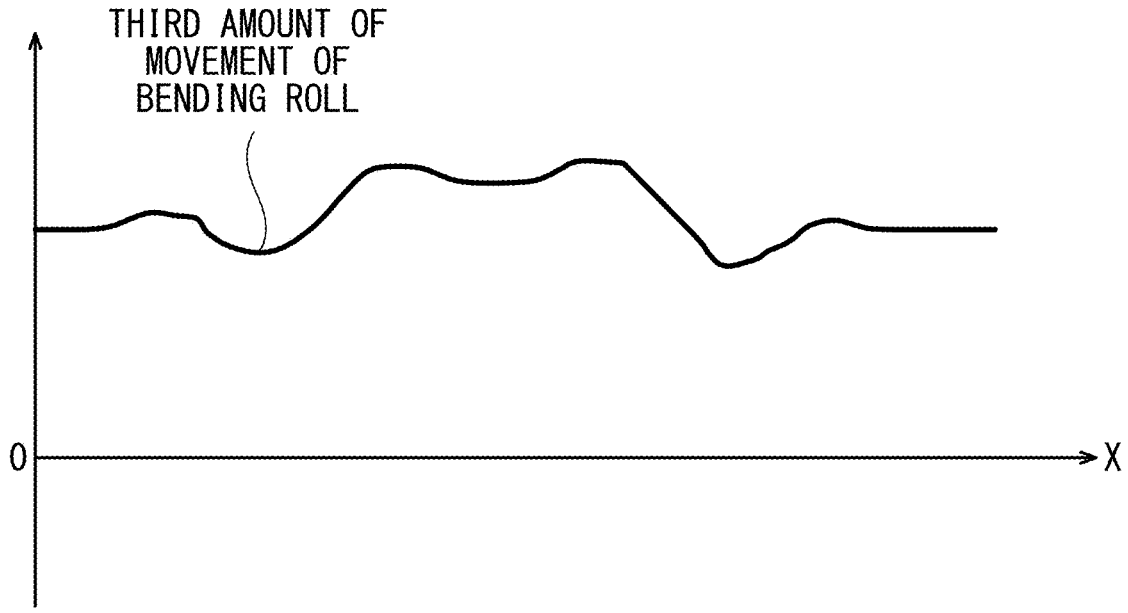
FIG. 10B shows a third amount of movement resulting from combining the first and second amounts of movement of the bending roll.

FIGS. 10A and 10B are schematic diagrams for explaining the amount by which the bending roll 103 is required to move to impart the first curvature to the single-sided varying-contour workpiece 20. FIG. 10A shows the first and second amounts of movement which have not yet been combined, and FIG. 10B shows the third amount of movement resulting from combining the first and second amounts of movement. As shown in FIG. 10A, the first amount of movement of the bending roll 103 is constant at a value such as zero over the entire length of the workpiece 20. In the case where the origin of the bending roll 103 includes an off-set value, the first amount of movement is constant at a value other than zero, while in the case where the origin of the bending roll 103 does not include any off-set value, the first amount of movement is zero.

In the case where the roll-formed part 40 as the end product is the same for the single-sided varying-contour workpiece 20 and the double-sided varying-contour workpiece 30, the single-sided varying-contour workpiece 20 and the double-sided varying-contour workpiece 30 have the same cross-sectional shape at any point in the longitudinal direction, and thus the moment of inertia of area at any point in the longitudinal direction is the same for the workpieces 20 and 30. Thus, the second amount of movement of the bending roll 103 in roll bending of the single-sided varying-contour workpiece 20 is the same as that second amount of movement of the bending roll 103 which is described above for the double-sided varying-contour workpiece 30 with reference to FIG. 7.

Thus, in roll bending of the single-sided varying-contour workpiece 20, the circuitry 104 obtains, as the amount of movement of the bending roll 103 in the width direction, a third amount of movement corresponding to the sum of the above-descried first and second amounts of movement. Based on the third amount of movement, the circuitry 104 controls the movement of the bending roll 103 via the roll driver 106. In consequence, the single-sided varying-contour workpiece 20 is formed into the roll-formed part 40 shown in FIG. 1.

Effects and Benefits

As described above, a roll-formed part production device according to the present disclosure is a device that produces an arc-shaped roll-formed part by performing roll bending of a workpiece while transferring the workpiece with a longitudinal direction thereof extending along a bending path, the workpiece being an elongate sheet material or elongate molded material including a varying-width portion where a width dimension of the workpiece varies in the longitudinal direction of the workpiece, the device including: rolls including a transfer roll that contacts at least an outer periphery of the workpiece and transfers the workpiece in the longitudinal direction, a support roll that is located downstream of the transfer roll on the bending path and that contacts at least an inner periphery of the workpiece and defines a support point at which the workpiece is bent, and a bending roll that is located downstream of the support roll on the bending path and that contacts at least the outer periphery of the workpiece and bends the workpiece; a roll driver that moves the transfer roll, the support roll, and the bending roll in a width direction of the workpiece; and circuitry, wherein an amount of movement of each of the rolls in the width direction is set as an amount of contact movement of the roll in accordance with a position of the workpiece in the longitudinal direction based on the width dimension of the workpiece, an amount of movement of the workpiece in the width direction at a point where the workpiece contacts the support roll is set as an amount of origin shift in accordance with the position of the workpiece in the longitudinal direction based on the amount of contact movement of the support roll, an amount by which each of the rolls moves in the width direction in accordance with the position of the workpiece in the longitudinal direction is set as a first amount of movement of the roll by combining the amount of contact movement of the roll and the amount of origin shift, an amount by which the bending roll moves in the width direction in accordance with the position of the workpiece in the longitudinal direction to bend an outer contour of the workpiece to a predetermined curvature is set as a second amount of movement based on a shape of the workpiece at the point where the workpiece contacts the support roll, and the circuitry is configured to: obtain an amount of movement corresponding to a sum of the first and second amounts of movement of the bending roll as an amount of movement of the bending roll in the width direction; and based on the obtained amount of movement of the bending roll in the width direction, operate the roll driver that moves the bending roll.

With the above configuration, an arc-shaped roll-formed part having an outer contour with a predetermined constant curvature and an inner contour with a varying curvature, having an outer contour with a varying curvature and an inner contour with a predetermined constant curvature, or having an outer contour with a varying curvature and an inner contour with a varying curvature, can be produced by roll bending of a workpiece that is an elongate sheet material or elongate molded material having a varying-width portion where the width dimension of the workpiece varies in the longitudinal direction of the workpiece.

The circuitry may be configured to: obtain the first amount of movement of the transfer roll as an amount of movement of the transfer roll in the width direction; based on the obtained amount of movement of the transfer roll in the width direction, operate the roll driver that moves the transfer roll; obtain the first amount of movement of the support roll as an amount of movement of the support roll in the width direction; and based on the obtained amount of movement of the support roll in the width direction, operate the roll driver that moves the support roll.

The second amount of movement may be obtained based on an outer contour shape of the workpiece that has not yet been subjected to the roll bending. The second amount of movement may be obtained based on at least a moment of inertia of area, a web width, or a cross-sectional area of the workpiece at the point where the workpiece contacts the support roll.

The second amount of movement may be obtained based on an amount of spring back that occurs in the workpiece that has been bent.

The workpiece may be a single-sided varying-contour workpiece that, before the roll bending, has an outer contour shaped as a straight line and an inner contour shaped as a varying contour, the circuitry may be configured to obtain an amount of movement as an amount by which the bending roll moves in the width direction during the roll bending, and the amount of movement obtained as the amount by which the bending roll moves in the width direction during the roll bending may correspond to a sum of a constant value that is the first amount of movement of the bending roll and the second amount of movement.

The workpiece may be a double-sided varying-contour workpiece that, before the roll bending, has an outer contour and an inner contour both of which are shaped as varying contours, the support roll may include an inner support roll that contacts the inner periphery of the workpiece and an outer support roll that contacts the outer periphery of the workpiece, the circuitry may be configured to: control the roll driver to move the transfer roll, the outer support roll, and the bending roll in the width direction in accordance with variation of the outer contour in the width direction at points where the workpiece contacts the transfer roll, the outer support roll, and the bending roll; and obtain the amount of contact movement of the bending roll as the first amount of movement of the bending roll, and the amount of contact movement of the bending roll may be an amount of variation of the outer contour in the width direction at the point where the workpiece contacts the bending roll.

The workpiece may be a double-sided varying-contour workpiece that, before the roll bending, has an outer contour and an inner contour both of which are shaped as varying contours, the support roll may include an inner support roll that contacts the inner periphery of the workpiece and an outer support roll that contacts the outer periphery of the workpiece, the circuitry may be configured to: control the roll driver to control a position of the outer support roll in the width direction such that an amount of movement of the outer support roll in the width direction differs from an amount of variation of the outer contour in the width direction at a point where the workpiece contacts the outer support roll; and obtain an amount of movement as the first amount of movement of the bending roll, the amount of movement obtained as the first amount of movement of the bending roll may result from combining the amount of origin shift and the amount of contact movement of the bending roll, the amount of origin shift may be a difference multiplied by minus 1, the difference being that between an amount by which, when the workpiece is transferred without being bent, the outer contour varies in the width direction at the point where the workpiece contacts the outer support roll and an amount by which the outer support roll moves in the width direction when the workpiece is transferred without being bent, and the amount of contact movement of the bending roll may be an amount of variation of the outer contour in the width direction at a point where the workpiece contacts the bending roll.

In this case, the first amount of movement of the transfer roll can be set in the same manner as the first amount of movement of the bending roll. That is, the circuitry may obtain, as the first amount of movement of the transfer roll, an amount of movement resulting from combining the following amounts of movement: an amount of movement that is a difference multiplied by minus 1, the difference being that between an amount by which, when the workpiece is transferred without being bent, the outer contour varies in the width direction at the point where the workpiece contacts the outer support roll and an amount by which the outer support roll moves in the width direction when the workpiece is transferred without being bent; and an amount of variation of the outer contour in the width direction at a point where the workpiece contacts the transfer roll.

According to an exemplary implementation, the present disclosure can provide a device and method capable of producing an arc-shaped roll-formed part having an outer contour with a predetermined first curvature and an inner contour with a varying curvature by roll bending of a workpiece that is an elongate sheet material or elongate molded material having a varying-width portion where the width dimension of the workpiece varies in the longitudinal direction of the workpiece.

The functionality of the elements disclosed herein may be implemented using circuitry or processing circuitry which includes general purpose processors, special purpose processors, integrated circuits, ASICs ("Application Specific Integrated Circuits"), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

What is claimed is:

1. A roll-formed part production device, comprising:

rolls including:

a transfer roll that contacts at least an outer periphery of a workpiece and transfers the workpiece in a longitudinal direction;

a support roll that is located downstream of the transfer roll on a bending path and that contacts at least an inner periphery of the workpiece and defines a support point at which the workpiece is bent, the support roll including an inner support roll and an outer support roll; and a bending roll that is located downstream of the support roll on the bending path and that contacts at least the outer periphery of the workpiece and bends the workpiece;

a roll driver actuator that moves the transfer roll, the support roll, and the bending roll in a width direction of the workpiece; and circuitry including a processor and memory, wherein an amount of movement of each of the rolls in the width direction is set as an amount of contact movement of each of the rolls in accordance with a position of the workpiece in the longitudinal direction based on the width dimension of the workpiece, an amount of movement of the workpiece in the width direction at a point where the workpiece contacts the support roll is set as an amount of origin shift in accordance with the position of the workpiece in the longitudinal direction based on the amount of contact movement of the support roll, an amount by which each of the rolls moves in the width direction in accordance with the position of the workpiece in the longitudinal direction is set as a first amount of movement of each of the rolls by combining the amount of contact movement of each of the rolls and the amount of origin shift, an amount by which the bending roll moves in the width direction in accordance with the position of the workpiece in the longitudinal direction to bend an outer contour of the workpiece to a predetermined curvature is set as a second amount of movement based on a shape of the workpiece at the point where the workpiece contacts the support roll, and the circuitry is configured to:

obtain an amount of movement corresponding to a sum of the first and second amounts of movement of the bending roll as an amount of movement of the bending roll in the width direction; and based on the obtained amount of movement of the bending roll in the width direction, operate the roll driver actuator that moves the bending roll.

2. The roll-formed part production device according to claim 1, wherein the circuitry is further configured to:

obtain the first amount of movement of the transfer roll as an amount of movement of the transfer roll in the width direction;

based on the obtained amount of movement of the transfer roll in the width direction, operate the roll driver actuator that moves the transfer roll;

obtain the first amount of movement of the support roll as an amount of movement of the support roll in the width direction; and based on the obtained amount of movement of the support roll in the width direction, operate the roll driver actuator that moves the support roll.

3. The roll-formed part production device according to claim 1, wherein:

the second amount of movement is obtained based on an outer contour shape of the workpiece that has not yet been subjected to bending by the bending roll.

4. The roll-formed part production device according to claim 1, wherein:

the second amount of movement is obtained based on at least a moment of inertia of area, a web width, or a cross-sectional area of the workpiece at the point where the workpiece contacts the support roll.

5. The roll-formed part production device according to claim 3, wherein:

the second amount of movement is obtained based on an amount of spring back that occurs in the workpiece that has been bent.

6. The roll-formed part production device according to claim 1, wherein:

the workpiece is a single-sided varying-contour workpiece that, before bending by the bending roll, has the outer contour shaped as a straight line and an inner contour shaped as a varying contour, the circuitry is configured to obtain an amount of movement as an amount by which the bending roll moves in the width direction during bending by the bending roll, and the amount of movement obtained as the amount by which the bending roll moves in the width direction during bending by the bending roll corresponds to a sum of a constant value that is the first amount of movement of the bending roll and the second amount of movement.

7. The roll-formed part production device according to claim 1, wherein:

the workpiece is a double-sided varying-contour workpiece that, before bending by the bending roll, has the outer contour and an inner contour both of which are shaped as varying contours, the support roll includes an inner support roll that contacts the inner periphery of the workpiece and an outer support roll that contacts the outer periphery of the workpiece, the circuitry is further configured to:

control the roll driver actuator to move the transfer roll, the outer support roll, and the bending roll in the width direction in accordance with variation of the outer contour in the width direction at points where the workpiece contacts the transfer roll, the outer support roll, and the bending roll; and obtain the amount of contact movement of the bending roll as the first amount of movement of the bending roll, and the amount of contact movement of the bending roll is an amount of variation of the outer contour in the width direction at the point where the workpiece contacts the bending roll.

8. The roll-formed part production device according to claim 1, wherein:

the workpiece is a double-sided varying-contour workpiece that, before bending by the bending roll, has the outer contour and an inner contour both of which are shaped as varying contours, the support roll includes an inner support roll that contacts the inner periphery of the workpiece and an outer support roll that contacts the outer periphery of the workpiece, the circuitry is configured to:

control the roll driver actuator to control a position of the outer support roll in the width direction such that an amount of movement of the outer support roll in the width direction differs from an amount of variation of the outer contour in the width direction at a point where the workpiece contacts the outer support roll; and obtain an amount of movement as the first amount of movement of the bending roll, the amount of movement obtained as the first amount of movement of the bending roll results from combining the amount of origin shift and the amount of contact movement of the bending roll, the amount of origin shift is a difference multiplied by minus 1, the difference being that between an amount by which, when the workpiece is transferred without being bent, the outer contour varies in the width direction at the point where the workpiece contacts the outer support roll and an amount by which the outer support roll moves in the width direction when the workpiece is transferred without being bent, and the amount of contact movement of the bending roll is an amount of variation of the outer contour in the width direction at a point where the workpiece contacts the bending roll.

9. The roll-formed part production device according to claim 1, wherein the bending roll has a sliding movement and a pivotal movement to maintain contact with the outer periphery or the inner periphery of the workpiece.

* * * * *